United States Patent [19]

Osada

[11] 4,322,885

[45] Apr. 6, 1982

[54] KNIFE APPARATUS

[75] Inventor: Hiroshi Osada, Seki, Japan

[73] Assignee: Kai Cutlery Center Co., Ltd., Seki, Japan

[21] Appl. No.: 157,869

[22] Filed: Jun. 9, 1980

[30] Foreign Application Priority Data

Jun. 23, 1979 [JP] Japan ..... 54-86188[U]

[51] Int. Cl.[3] ..... B26B 1/08

[52] U.S. Cl. ..... 30/162; 30/320

[58] Field of Search ..... 30/162, 320

[56] References Cited

U.S. PATENT DOCUMENTS 4,170,062 10/1979 Machida ..... 30/320 X 4,232,445 11/1980 Ito ..... 30/162

FOREIGN PATENT DOCUMENTS 1522454 8/1978 United Kingdom ..... 30/320

*Primary Examiner*—Jimmy C. Peters

*Attorney, Agent, or Firm*—Norbert P. Holler; Charles A. Blank

[57] ABSTRACT

A knife apparatus comprises an elongated handle member formed with a groove of a C-like cross-section, a slide unit disposed longitudinally slidably within the groove, and a blade slidably disposed in the groove and having a base portion connected to the slide unit. Locking member is provided for the slider unit and adapted to mesh with a tooth train formed in at least one longitudinal edge of the groove, to thereby immobilize the slide unit and hence the blade relative to the handle. A manipulator plate having a cam groove is disposed on the slide unit over the locking member to control the locking member, whereby the slide unit is moved between the locked and the released positions under the control of the manipulator plate.

5 Claims, 5 Drawing Figures

KNIFE APPARATUS

BACKGROUND OF THE INVENTION

1. Field of the Invention

The present invention relates to a knife apparatus including a knife handle or grip having a substantially C-shaped cross-section defining a groove or a channel extending longitudinally thereof and a slide unit having a blade secured thereto and slidably received by the channel so that the blade can be withdrawn or projected bit by bit outwardly as the knife edge thereof wears out.

2. Description of the Prior Art

In the knife apparatus of the type described above, it has been hitherto known that a series of notches or teeth are formed in the knife handle or grip along the groove on one hand, while a V-shaped spring member is mounted on the slide unit on the other hand, whereby the slide unit and hence the blade are securely held by the knife handle through the mutual engagement of the V-shaped spring and the notch. When the slide unit is moved to project the blade outwardly, the V-shaped spring is yieldably deformed to disengage from the notch. Such conventional structure is, however, disadvantageous in that the blade can not be securely held by the knife handle or grip at the indexed position since the locked or latched state of the slide unit is assured only by the resiliency of the V-shaped spring member. Consequently, there may arise a danger of the blade tottering or rattling particularly in the applications where a relatively great cutting force is required. Of course, more positive locking of the slide unit as well as the blade to the knife handle may be attained by using a spring member having a correspondingly increased spring force. However, by doing so, the force required for smoothly sliding the slide unit is increased inconveniently.

To avoid this problem, there have been proposed various knife apparatus having means for releasably but forcibly keeping the V-shaped spring in engagement with the notch. However, with all these means, it was still difficult to rigidly smoothly lock the blade at an indexed position with a simple, smooth manipulation. Also, it was difficult to assure sufficient strength and easy manufacture of the knife apparatus. Such problem becomes remarkable particularly in the knife apparatus in which a blade of a small width is to be incorporated.

SUMMARY OF THE INVENTION

Accordingly, a primary object of the present invention is to provide a knife apparatus of the type described hereinbefore in which a knife blade can be rigidly reliably held by a grip portion with a simple, smooth manipulation, and at the same time the blade can be withdrawn or projected bit by bit outwardly through a simple, smooth manipulation.

In view of the above and other objects which will become more apparent, there is provided according to a general aspect of the invention a knife apparatus comprising an elongated handle member having longitudinal edge portions bent in opposite to each other so as to form a groove in the handle, at least one of the longitudinal edge portions being formed with a series of teeth, a slide unit disposed longitudinally slidably within the groove of the handle, a blade slidably disposed in the groove in substantially longitudinal alignment with the slide units and having a base portion connected to the slide unit, a locking member provided in the slide unit and adapted to be movable between a first position at which the locking member meshes with the tooth train to immobilize the slide unit and the blade and a second position at which the slide unit and hence the blade can be moved longitudinally in the groove, a manipulator member disposed on the slider unit over the locking member movably longitudinally relative to the locking member in a predetermined range, and control means provided in combination with the locking member and the manipulator member to selectively move the locking means to one of the first and second positions in response to operation of the manipulator member.

DETAILED DESCRIPTION OF THE PREFERRED EMBODIMENTS

Figure 1:
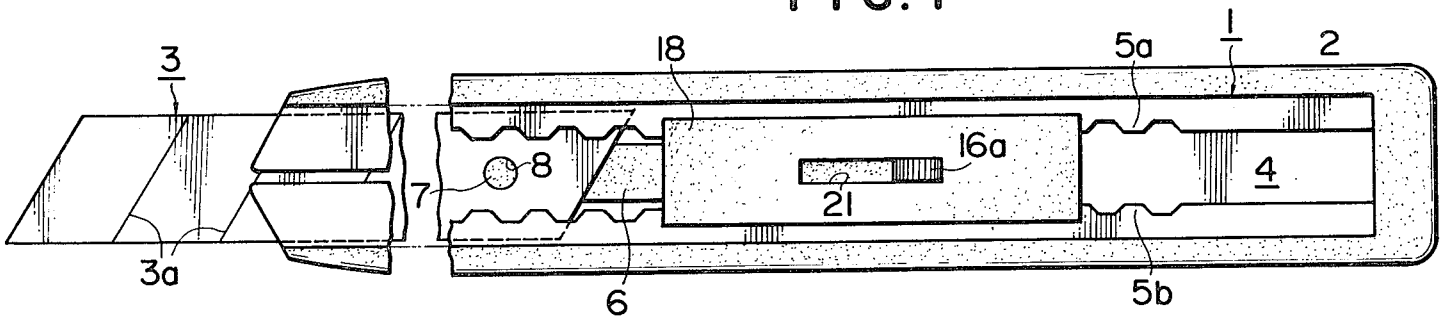
FIG. 1 is a front view showing a knife apparatus according to an embodiment of the invention with a portion being broken away.

Now, the invention will be described in detail in conjunction with a knife assembly having a replaceable blade portion according to an embodiment of the invention by referring to the drawings.

Reference numeral 1 denotes generally a holder or handle of the knife which is constituted by an elongated sleeve member having a substantially C-shaped rectangular cross-section and has an outer wall 2 adapted to be gripped by a hand of user. The sleeve-like handle 1 is closed at a rear end portion (right end as viewed in FIG. 1) while it is opened at a front end (lefthand side as viewed in FIG. 1) to form a slit-like aperture through which a blade 3 projects outwardly. A plurality of score lines 3*a* are formed in a lateral surface of the blade 3 with a predetermined pitch so that blade segments defined between the adjacent score lines 3*a* can be individually broken along the score lines 3*a*. In this way, when the edge of one segment of the blade 3 becomes dull or worn out, the blade 3 is pushed outwardly in a stepwise manner as described hereinafter, whereby the worn-out blade is broken away along the score line 3*a* to be replaced by a fresh blade portion. A length of the blade 3 is of course slidably held in a guide chamber groove formed in the knife holder 1. A hole 8 is formed in the blade 3 at the rear end or base portion and adapted to snugly receive therein a connecting stud 7 formed integrally in a slider unit 6 which will be hereinafter described in detail, so that the blade 3 is connected to the slider unit.

Figure 2:
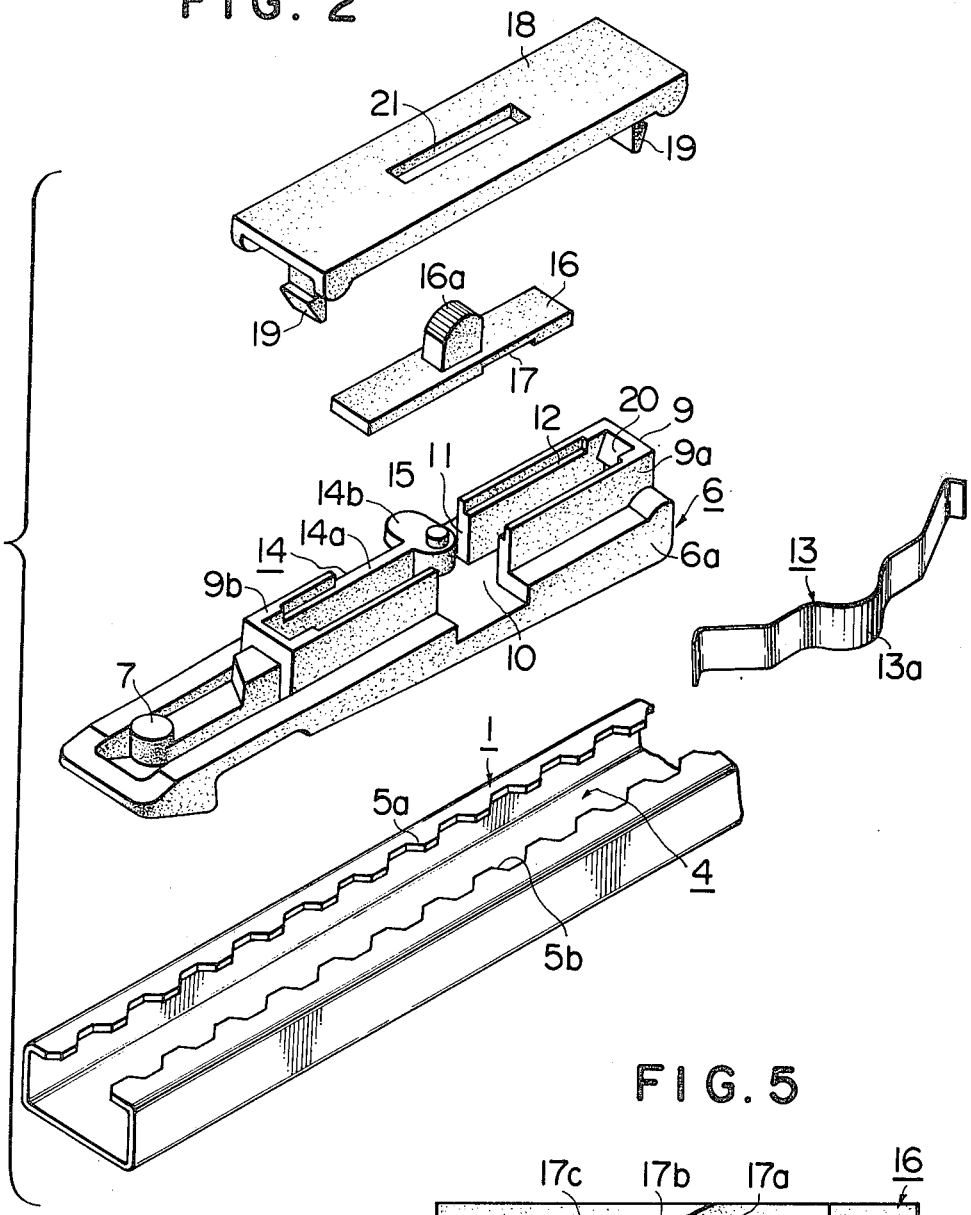
FIG. 2 is an exploded perspective view of the knife apparatus shown in FIG. 1.

There is formed in a lateral side wall (front wall as viewed in FIGS. 1, 3 and 4) of the rectangular sleeve-like handle 1 an elongated rectangular window or slot 4 which has a longitudinal axis extending substantially coaxially with the longitudinal axis of the knife handle 1. Accordingly, the portion of the handle 1 in which the slot 4 is formed has a C-like cross-section to form the guide channel, as can be seen from FIG. 2. Longitudinal edges of the slot 4 projecting inwardly in opposition to each other are formed with trains of teeth 5*a* and 5*b*, respectively, at the substantially same pitch as that of the score lines 3*a*.

The slide unit described above is generally designated by a reference numeral 6 and includes a base portion 6*a* and a rectangular upstanding enclosure 9 formed integrally on the base portion 6*a*. The dimensions of the slider base portion 6*a* as well as the elongated rectangular enclosure 9 are so selected that the former is slidably contained within the channel formed in the knife handle 1 while the latter is slidably sandwiched between the opposite longitudinal edges of the slot 4. A pair of notches 10 and 11 are formed in the longitudinal side walls 9*a* and 9*b* of the elongated enclosure 9. A leaf spring 13 of a substantially triangular shape having a protrusion 13*a* is disposed within the enclosure 9 with the protrusion 13*a* extending outwardly through the notch 10 to releasably engage in an intertooth space between the adjacent teeth of the tooth train 5*b*, as can be seen from FIG. 3. The leg portions of the leaf spring 13 bear against the inner surface of the side wall 9*b*, while intermediate shoulder portions of the spring 13 are pressed against the inner surface of the upstanding side wall 9*a* under the inherent resiliency of the spring 13, whereby the latter is fixedly accommodated within the enclosure 9. The feeding of the blade 3 is effected in a stepwise manner at a pitch corresponding to that of the score lines 3*a* or teeth train 5*a* due to the releasable engagement between the protrusion 13*a* of the leaf spring 13 and the intertooth space of the tooth train 5*b*.

Figure 3:
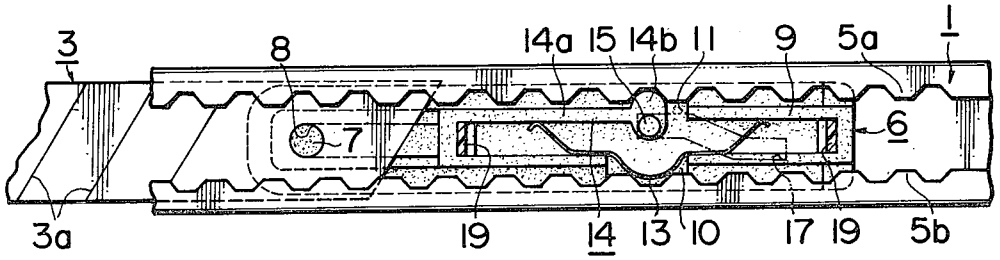
FIG. 3 is a front view of the knife apparatus with some parts removed to illustrate the locked state of the knife apparatus.
Figure 4:
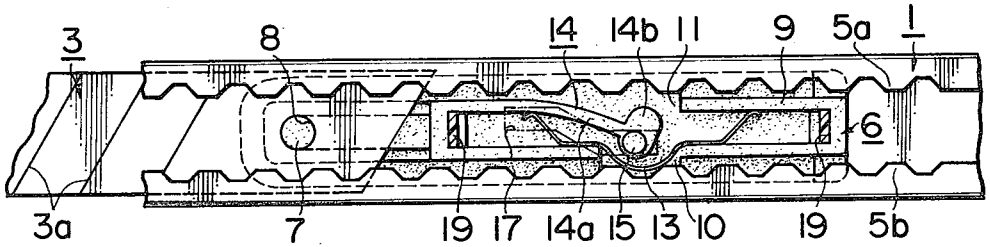
FIG. 4 is a view similar to FIG. 3 and illustrates the unlocked or released state in which the blade can be fed outwardly.

On the other hand, a locking member 14 is formed in the upstanding wall 9*b* of the enclosure 9 and includes a lock arm 14*a* which may be constituted by a left hald portion of the wall 9*b* (as viewed in FIG. 2) and a locking projection 14*b* formed at the free end of the lock arm 14*a*. The locking projection 14*b* is located at the notch 11 to project therethrough thereby to engage the intertooth space of the tooth train 5*a* in alignment with the spring protrusion 13*a* meashing with the intertooth space of the opposite tooth train 5*b*, as is shown in FIG. 3. In this connection, it is preferred that the slider unit 6 be integrally formed of a material exhibiting a resiliency such as an elastomer. In this case, the lock member 14*b* is imparted with an inherent resiliency. The locking member 14*b* is provided with a stud 15 at a top surface which serves as a cam follower as will be described below.

Figure 5:
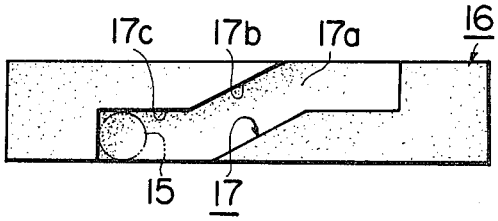
FIG. 5 is a bottom plan view of a manipulator plate used in the knife apparatus to selectively set the blade in the locked or unlocked state.

A manipulator plate 16 having a knob 16*a* (refer to FIG. 2) is slidably disposed on offset rail portions 12 formed along the longitudinal top edges of the side walls 9*a* and 9*b* within the enclosure 9. Referring to FIG. 5, there is formed in the bottom surface of the manipulator plate 16 a cam groove 17 in which the cam follower stud 15 described above is movably disposed. The cam groove 17 includes end groove sections 17*a* and 17*c* extending longitudinally and in parallel to each other and an inclined groove section 17*b* interposed between the parallel groove sections 17*a* and 17*c*. It will be appreciated that the lock member 14 is swingably bent as the manipulator plate 16 is reciprocatively moved along the rails 12 under the camming action exerted by the cam groove 17 to the stud 15, whereby the locking projection 14*b* is alternatively engaged in or disengaged from the intertooth space of the tooth train 5*a*. When the locking projection 14*b* engages in one of the intertooth spaces of the tooth train 5*a*, the slider unit 6 is positively locked immovably in cooperation with the angle spring 13 having the protrusion 13*a* engaged with the oppositely located intertooth space of the tooth train 5*b*. More specifically, when the manipulator plate 16 is moved rearwardly (i.e., in the direction opposite to the blade 3), the locking projection 14*b* is caused to mesh with one of the intertooth spaces of the tooth train 5*a* under the camming action exerted by the cam groove 17 to the stud 15, whereby the slider unit 6 and hence the blade 3 connected thereto are brought to the locked state, while upon forward movement of the manipulator plate 16 the locking projection 14*b* is caused to disengage from the intertooth space of the tooth train 5*a* under the camming action of the cam groove 17, as the result of which the slider unit 6 can be moved stepwise by overcoming the action of the detent spring 13 to thereby push the blade 3 outwardly from the knife handle 1.

Reference numeral 18 denotes a cover plate which is snugly fitted to the open top of the enclosure 9. To this end, a pair of hooks 19 are formed in the lower surface of the cover plate 18 at both ends thereof and adapted to be latched by a pair of corresponding hooks 20 formed in the end walls of the enclosure 9. Further, the cover 18 is formed with a slit 21 through which the knob 16*a* affixed to the manipulator plate 16 extends freely. It will be apparent that the manipulator plate 16 can be moved reciprocatively with the aid of the knob 16*a* projecting through the slit 21 and guided along it.

FIG. 3 shows the locked state of the slider unit 6 in which the manipulator plate 16 has been moved rearwardly, whereby the stud 15 of the locking projection 14*b* is retained at the cam groove section 17*c* to cause the locking projection 14*b* to engage in one of the intertooth spaces of the tooth train 5*a*.

Starting from the locked position described above, forward sliding movement of the manipulator plate 16 to position the cam follower stud 15 in the cam groove section 17*a* by means of the knob 16*a* will cause the locking projection 14*b* to be disengaged from the intertooth space of the tooth train 5*a* under the deflecting action exerted to the stud 15 by the slanted cam groove section 17*b*, whereby the slider unit 6 can be moved forwardly by further applying to the manipulator knob 16*a* a force of a magnitude to overcome the spring force of the detent spring 13 to thereby allow the blade 3 to be pushed outwardly by a desired length. At this position, the worn-out or dull blade segment can be broken off along the score line 3*a* and replaced by a fresh one. Subsequently, the manipulator knob 16*a* and hence the manipulator plate 16 can be moved rearwardly to the position at which the cam follower stud 15 is retained at the groove section 17*c*. In this state, the locking projection 14*b* is enforcively caused to engage in one of the intertooth spaces, thereby the slider unit 6 as well as the blade 3 are positively locked unmovably in cooperation with the detent spring 13 having the protrusion 13*a* engaged with the oppositely located intertooth space of the tooth train 5*b*. In this locked state, the knife can be safely used without involving unintentional movement of the blade 3.

As will be appreciated from the foregoing description, the slide unit 6 can be positively locked through cooperation of the locking projection 14*b* adapted to engage in an intertooth space between the adjacent teeth of the tooth train 5*a* and the angle or V-like spring 13 having the protrusion 13*a* engaged in the intertooth space of the opposite tooth train 5*b* and positioned in a transversal alignment with the locking projection 14*b*, whereby the blade 3 connected to the slide unit 6 is securely held at the indexed position without tottering or rattling to thereby assure a safe use of the cutter knife even in the applications where a relatively great force is required for the cutting operations.

The locking state of the knife described above can be established or released in an extremely simple manner merely by moving the manipulator plate 16 in the corresponding direction, whereby the blade portion of the worn edge can be very easily replaced by a fresh one.

Because the manipulator plate 16 having the cam grooves for controlling the locking projection 14*b* is mounted on the slide unit 6 over the locking member 14 slidably relative to the slide unit in the longitudinal direction, the cutter knife can be implemented in a small and compact structure with a high rigidity. This feature in combination with the advantageous locking mechanism described above allows the use of a blade of a narrow width with an improved safety and reliability.

In the case where members corresponding to the manipulator plate and the locking member are arranged in side-by-side relation, both of these members have to be designed to have a small width so as to allow the members to be disposed in a limited narrow area. Such members of small width are difficult to manufacture and are small in strength, and this problem becomes remarkable particularly in the knife apparatus in which a blade of a small width is to be incorporated. The structure of the invention obviates such disadvantage since the manipulator plate 16 and the locking member 14 are arranged in a vertically adjacent relation.

Although the invention has been described in conjunction with an exemplary embodiment illustrated in the accompanying drawings, it will be appreciated for those skilled in the art that many and various modifications may be made without departing from the scope and spirit of the invention. For example, the locked state of the slider unit is established by moving the manipulator plate 16 in the rearward direction in the case of the illustrated embodiment, however, it is possible to arrange such that the slider unit and hence the blade are locked at the indexed position by moving the manipulator plate forwardly.

What is claimed is:

1. A knife apparatus comprising an elongated handle member having longitudinal edge portions bent in opposite to each other so as to form a groove in said handle, at least one of said longitudinal edge portions being formed with a series of teeth, a slide unit disposed longitudinally slidably within said groove of said handle, a blade slidably disposed in said groove in substantially longitudinal alignment with said slide unit and having a base portion connected to said slide unit, a locking member provided in said slide unit and adapted to be movable between a first position at which said locking member meshes with said tooth train to immobilize said slide unit and said blade and a second position at which said slide unit and hence said blade can be moved longitudinally in said groove, a manipulator member disposed on said slide unit over said locking member movably longitudinally relative to said locking member in a predetermined range, and control means provided in combination with said locking member and said manipulator member to selectively move said locking member to one of said first and second positions in response to corresponding operation of said manipulator member, said locking member being formed integrally with said slide unit and having a flexible arm and a lock portion formed at the free end of said flexible arm and adapted to disengageably mesh with said tooth train, said control means including a cam groove provided at the lower side of said manipulator member, and a cam follower stud formed in said lock portion and adapted to be guided by said cam groove.

2. A knife apparatus according to claim 1, wherein said cam groove includes first groove portion slanted relatively to the moving direction of said manipulator member, and second groove portions extending from both ends of said first groove portion in parallel to the moving direction of said manipulator member, each said second groove portion corresponding to one of said first and second positions of said locking member.

3. A knife apparatus according to claim 1, wherein both of said longitudinal edge portions of said groove are formed with the tooth trains, respectively, further including deformable spring means disposed fixedly on said slider unit and having a portion projecting to mesh with the tooth train formed in the other longitudinal edge portion.

4. A knife apparatus according to claim 3, wherein said locking member and said projecting portion of said spring are substantially aligned to each other in the direction perpendicular to said longitudinal direction.

5. A knife apparatus according to claim 1, wherein said blade is formed with score lines at a pitch substantially corresponding to the pitch of said tooth train, so that said blade can be broken away along the score line to replace the worn blade portion with a fresh blade portion.

* * * * *